US012185844B2

(12) United States Patent
Tanaka

(10) Patent No.: US 12,185,844 B2
(45) Date of Patent: Jan. 7, 2025

(54) BACKREST OF CHAIR

(71) Applicant: Eiichirou Tanaka, Kawagoe (JP)

(72) Inventor: Eiichirou Tanaka, Kawagoe (JP)

( * ) Notice: Subject to any disclaimer, the term of this patent is extended or adjusted under 35 U.S.C. 154(b) by 99 days.

(21) Appl. No.: 18/299,050

(22) Filed: Apr. 12, 2023

(65) Prior Publication Data

US 2023/0389708 A1 Dec. 7, 2023

(30) Foreign Application Priority Data

Jun. 2, 2022 (JP) ..... 2022-099216

(51) Int. Cl.
*A47C 3/12* (2006.01)
*A47C 5/12* (2006.01)
*A47C 7/46* (2006.01)

(52) U.S. Cl.
CPC ..... *A47C 7/46* (2013.01); *A47C 3/12* (2013.01); *A47C 5/12* (2013.01)

(58) Field of Classification Search
CPC ..... A47C 7/46; A47C 3/12; A47C 5/12
USPC ..... 297/284.1, 284.2, 284.4, 291, 452.31, 297/452.33, 452.34; D6/366
See application file for complete search history.

(56) References Cited

U.S. PATENT DOCUMENTS 3,948,558 A * 4/1976 Obermeier ..... A47C 7/462 297/284.4
4,182,533 A * 1/1980 Arndt ..... A47C 7/462 297/284.4
4,295,681 A * 10/1981 Gregory ..... A47C 7/462 297/284.4
4,607,882 A * 8/1986 Opsvik ..... A47C 9/002 297/452.31 X
D289,708 S * 5/1987 Rykken ..... D6/366
4,810,033 A * 3/1989 Kemmann ..... A47C 7/462 297/284.4
5,040,848 A * 8/1991 Irie ..... A47C 7/46 297/452.31 X
5,112,108 A * 5/1992 Zapf ..... A47C 7/445 297/291 X
5,129,707 A * 7/1992 Yamauchi ..... B60N 2/68 297/452.18
D376,486 S * 12/1996 Lenger ..... D6/358
5,637,076 A * 6/1997 Hazard ..... A61H 1/0292 297/284.6

(Continued)

FOREIGN PATENT DOCUMENTS

DE 4233627 A1 * 4/1994 ..... A47C 7/46
GB 2165445 A * 4/1986 ..... A47C 1/03205

(Continued)

*Primary Examiner* — Rodney B White
(74) *Attorney, Agent, or Firm* — Yokoi & Co., U.S.A.; Toshiyuki Yokoi

(57) ABSTRACT

Provided with a backrest of a chair capable of reducing lumbago and fatigue by supporting a spinal column (2) straightly. A backrest (1) of a chair to support a back of erector spinae muscles (6, 6) with a planar rigid body in a region from both shoulder blades (3, 3) to both iliac bones (4, 4) for straightly supporting a spinal column (2) while avoiding an influence of both shoulder blades (3, 3) and both iliac bones (4*a*, 4*a*), wherein a width of the planar rigid body is broadened to right and left within a range where the planar rigid body is not in contact with a lower part of the ribs and both iliac crests (4*a*, 4*a*).

2 Claims, 7 Drawing Sheets

(56) References Cited

U.S. PATENT DOCUMENTS 5,718,476 A * 2/1998 De Pascal ..... A47C 7/462 297/284.4
6,189,972 B1 * 2/2001 Chu ..... A47C 7/465 297/284.4
6,260,921 B1 * 7/2001 Chu ..... A47C 7/465 297/284.4 X
6,394,547 B1 * 5/2002 Vik ..... A47C 7/46 297/423.26
6,692,081 B2 * 2/2004 Vik ..... A47C 7/46 297/463.1
7,000,987 B2 * 2/2006 Staarink ..... A47C 7/46 297/354.11
D549,495 S * 8/2007 Van Landingham ..... D6/716.4
7,334,841 B2 * 2/2008 Chou ..... A47C 7/462 297/284.4
7,578,797 B2 * 8/2009 Hazard ..... A47C 3/0255 601/24
7,794,017 B2 * 9/2010 Kan ..... A47C 1/03255 297/284.4 X
7,837,265 B2 * 11/2010 Machael ..... A47C 1/03266 297/300.2
D641,562 S * 7/2011 Lee ..... D6/366
D653,044 S * 1/2012 Schaack ..... D6/366
8,297,701 B2 * 10/2012 Machael ..... A47C 1/03272 297/300.2
D673,397 S * 1/2013 Opsvik ..... D6/716.1
D673,398 S * 1/2013 Opsvik ..... D6/716.4
D692,247 S * 10/2013 Opsvik ..... D6/366
8,926,017 B2 * 1/2015 Grove ..... A47C 3/0252 297/284.1 X
D763,588 S * 8/2016 Chen ..... D6/366
D770,789 S * 11/2016 Chen ..... D6/366
11,051,622 B2 * 7/2021 Kopperud ..... A47C 7/425
11,129,479 B2 * 9/2021 Snyder ..... A47C 11/005
11,337,525 B1 * 5/2022 Wu ..... A47C 7/448
11,464,342 B2 * 10/2022 Snyder ..... A47C 7/18
2007/0001497 A1 * 1/2007 Diffrient ..... A47C 1/03294 297/321
2021/0368989 A1 * 12/2021 Snyder ..... A47C 11/005

FOREIGN PATENT DOCUMENTS

JP 2009106346 A * 5/2009
WO WO-8504084 A1 * 9/1985 ..... A47C 7/46

* cited by examiner

BACKREST OF CHAIR

CROSS-REFERENCE TO RELATED APPLICATIONS

This patent specification is based on Japanese patent application, No. 2022-099216 filed on Jun. 2, 2022 in the Japan Patent Office, the entire contents of which are incorporated by reference herein.

BACKGROUND OF THE INVENTION

The present invention relates to a backrest of a chair.

Conventionally, an improvement of the backrest of the chair has been attempted for reducing lumbago and fatigue in a sitting posture. The present invention improves the above described problem by straightly supporting a spinal column. There is no specific proposal and no suggestive proposal in the past for improving the above described problem by straightly supporting the spinal column. On the other hand, there are a lot of backrests formed in a planar shape since ancient times. However, even if a person leans against it, the spinal column does not become straight. Furthermore, there is still room for improvement of the above described problem in terms of feeling of use over many years.

SUMMARY OF THE INVENTION

The present invention reduces lumbago and fatigue in a sitting posture. The lumbago and the fatigue are mainly caused by a backward tilting of a pelvis due to the sitting and a curvature of a lumbar portion in C-shape induced by the backward tilting of the pelvis. Furthermore, buckling occurs in the lumbar portion since the weight of the upper body is applied to the curvature of the lumbar portion. This increases the curvature of the lumbar portion and causes to increase the lumbago. In addition, the buckling of the lumbar portion acts so as to displace the lumbar portion further backward. On the other hand, since the lumbar portion is pressed against the backrest, the pressure of supporting the lumbar portion increases. Furthermore, since the contact area is reduced by the curvature of the lumbar portion, the supporting pressure per unit area increases. This also causes poor circulation.

As described above, when the curvature occurs in a certain part of the spinal column, the buckling is caused by the weight of the upper body. This causes the lumbago and the fatigue. Accordingly, if the spinal column is straightly supported, the buckling of the spinal column can be prevented. However, the weight of the upper body applied to the spinal column is received not only by the spinal column but also by the buttocks through the pelvis. Thus, the buckling should be prevented in the entire path receiving the weight. Accordingly, the supporting position for preventing the backward tilting of the pelvis should be also considered in relation to the spinal column.

Conventionally, there are many chairs where the backrest is formed in a planar shape. However, these chairs cannot support the spinal column straightly. This is because the back of a person does not have a planar shape. The explanation will be made by using FIG. 3. Both shoulder blades 3, 3, both iliac crests 4*a*, 4*a* and a lower part of a sacrum 5 are protruded backward compared to erector spinae muscles 6, 6 (portion for straightly supporting a spinal column 2 shown in FIG. 4) and the positions of them are different from each other and the influences of them are different from each other. Accordingly, when the backrest having a planar shape for merely covering an entire back of the person is used, the spinal column 2 does not become straight even when the back of the person is pressed toward the backrest. In addition, it is also necessary to prevent the backward tilting of the pelvis caused by the weight of the upper body. Thus, it is important to support the lumbar located near the connection portion between the sacrum 5 and the lumbar. The above described portion is located between both iliac bones 4, 4 and located at a position slightly recessed from the both iliac bones 4, 4. Therefore, if the backrest having a planar shape straddling the both iliac bones 4, 4 is used, a gap is formed and the above described portion is not supported. Accordingly, the lumbar portion is displaced backward to fill the above described gap. Thus, the backward tilting of the pelvis and the curvature of the lumbar are caused. In order to prevent the above described problem, it is necessary to support the positon between the both iliac bones 4, 4. As described above, in order to support the spinal column 2 straightly, the supporting position for preventing the backward tilting of the pelvis in addition to the spinal column is important.

Furthermore, the spinal column 2 does not become straight only by supporting the erector spinae muscles 6, 6 by a planar shape from the backward within a range from the both shoulder blades 3, 3 to the both iliac bones 4, 4. This is because the gravity center of the upper body is located frontward than the spinal column 2 and ribs do not exist at the stomach. Thus, the force of bending frontward is applied to the spinal column 2 near the stomach and the supporting pressure is higher at that portion than the other portions. As a result, the deformation of the erector spinae muscles 6, 6 is more significant at the above described portion than the other portions and the spinal column 2 is not supported straightly. Accordingly, it is required to uniformize the deformation of the erector spinae muscles 6, 6 entirely. Thus, it is required to broaden a supporting area to right and left and correct the deformation evenly within a range of not contacting with a lower part of the ribs and the both iliac crests 4*a*, 4*a*.

The present invention provides a backrest 1 of a chair to support a back of erector spinae muscles 6, 6 with a planar rigid body in a region from both shoulder blades 3, 3 to both iliac bones 4, 4 while avoiding the both shoulder blades 3, 3 and the both iliac crests 4*a*, 4*a* which are portions protruded backward compared to the erector spinae muscles 6, 6 vertically located at both sides of a spinal column 2, wherein a width of the planar rigid body is broadened to right and left within a range where the planar rigid body is not in contact with a lower part of ribs and both iliac crests 4*a*, 4*a*.

In the above described configuration, although the back of erector spinae muscles 6, 6 is supported with the planar rigid body, the degree of influence how the warpage of the planar shape affects the feeling of sitting is shown below. (The backrest is placed on a flat surface without having a warpage and a gap formed at a center portion is measured. The vertical length of the backrest used here is 33 cm.)

According to the experiment, the feeling of sitting is same as that of the planar surface when the warpage of the protrusion side (the direction where the lumbar is inclined forward) is 1 mm or less. In addition, the feeling of sitting is same as the planar surface when the warpage of the recess side, which is the opposite direction of the protrusion side, is 0.5 mm or less. The difference can be felt when the warpage of the protrusion side is 2 mm or more and the warpage of the recess side is 1 mm or more. Since the feeling of sitting deteriorates continuously as the warpage increases, the degree of the improvement varies depending on where the point of compromise is. It is considered that the point of compromise is approximately 3 mm in the warpage of the protrusion side and approximately 2 mm in the warpage of the recess side.

Although the above described warpage is measured by using the backrest 1 made of a rigid body, it is also possible to support the spinal column 2 straightly even when the backrest 1 is made of an elastic material having flexibility. This is because the supporting pressure is distributed uniformly over the entire surface of the backrest 1 in the present invention. Thus, even when the elastic material having flexibility is used, the entire surface is deformed uniformly and a flat surface is maintained. However, when the elastic material having flexibility is used, it is required to arrange a rigid board behind the backrest 1 for the purpose of preventing the warpage of the entire backrest 1.

The gravity force applied to the upper body when the spinal column 2 is supported straightly is considered to be divided into the first component force applied in the direction of the spinal column 2 (direction along the spinal column 2) and the second component force applied orthogonal to the surface of the backrest 1, where the second component force is orthogonal to the first component force. The first component force applied in the direction of the spinal column 2 is received by the buttocks via the pelvis without causing the buckling of the spinal column 2. In the above described process, the backward tilting of the pelvis can be prevented by supporting between the both iliac bones 4, 4. On the other hand, the second component force applied orthogonal to the surface of the backrest 1 is distributed uniformly over the entire surface of the backrest 1 (since the buckling is not caused and the area of the backrest 1 is corrected). Thus, the deformation of the erector spinae muscles 6, 6 can be uniformed.

The natural posture not causing excess burden on the lumbar portion relates to the inclination of the pelvis. In the standing posture, the pelvis is slightly inclined forward. Thus, the natural posture of the lumbar portion is the forwardly inclined state. On the other hand, in the process of sitting down, the pelvis is inclined backward by pulling by gluteus maximus muscle, hamstring and the like. Thus, the lumbar portion is shifted from the above described forwardly inclined state to the straight state and then shifted to a C-shaped curved state leaning forward as the pelvis inclines backward. The posture formed in accordance with the inclination degree of the pelvis is the natural posture. In order to change the natural posture, muscular force or external force should be applied. From the above described fact, the state where the lumbar is forwardly inclined cannot be the natural posture in the sitting posture different from the standing posture. Accordingly, the present invention can reduce the lumbago and the fatigue by enabling to support the lumbar straightly (i.e., a little curvature) in the above described natural posture.

Even when the sitting position is slightly displaced in the front-back direction, the effect of the present invention can be maintained since the angle of the backrest 1 is changed depending on the sitting position so that the backrest 1 is in close contact with the back of the person. On the contrary, the angle of the backrest 1 can be selected by changing the sitting position. In addition, since a moment is not generated on the backrest 1 when a person leans against the backrest 1, the reaction force to change the posture is not generated. Thus, the natural posture where muscles are not used can be maintained.

DETAILED DESCRIPTION OF THE INVENTION

Figure 1:
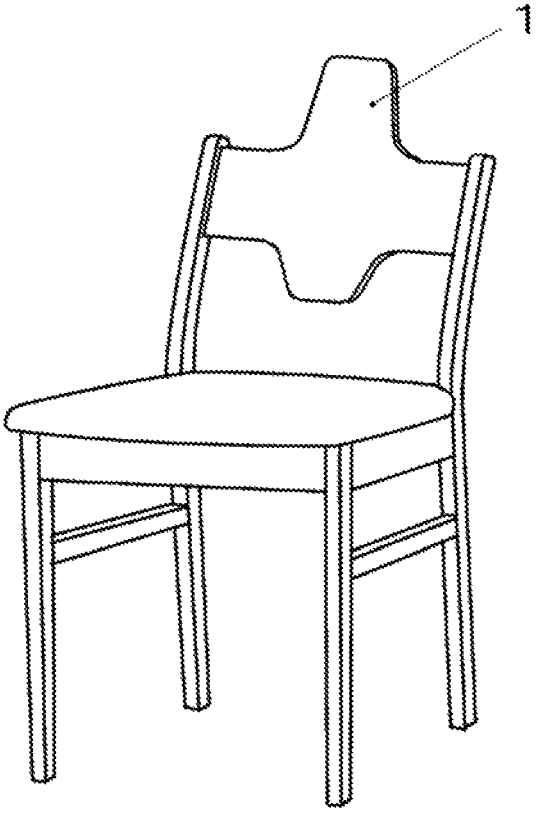
FIG. 1 is a perspective view where a backrest of the present invention is applied to a chair.
Figure 2:
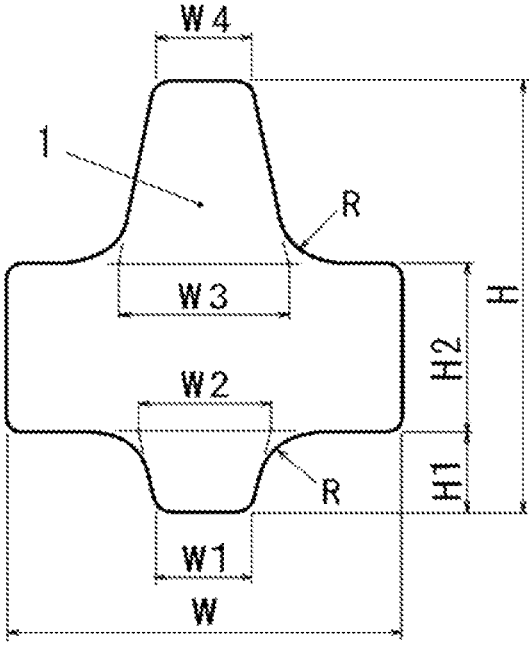
FIG. 2 is a dimensional drawing showing a shape of the backrest of the present invention.

FIG. 1 is a perspective view where the backrest of the present invention is applied to the chair. The dimension showing the shape of the backrest 1 is shown in FIG. 2. The backrest 1 is formed by the planar rigid body and a portion where the width is broadened is fixed to supports of the chair at both left and right sides. The portion where the width is broadened is functionally plays the role (of correcting the supporting pressure) within the range of approximately 24 cm and both outer ranges play the role of being fixed to the supports of the chair. The gap between a seat surface and a lower end of the backrest 1 is specified to 10 cm (conformable to the height of approximately 170 cm). However, it is also possible to add a vertically adjustable mechanism to the backrest 1 for expanding the application range. In the present embodiment, the seat surface is specified to be flat and the angle between the seat surface and the backrest 1 is specified to be 113 degrees. The materials such as woods and plastics widely used in the chair are also applied to the present invention.

FIG. 2 is a dimensional drawing showing the shape of the backrest of the present invention. The dimensions conformable to the height of approximately 170 cm are shown below.

W=30 cm, W1=8 cm, W2=10 cm, W3=13 cm, W4=8 cm, H=33 cm, H1=6 cm, H2=13 cm, R=4 cm

Figure 3:
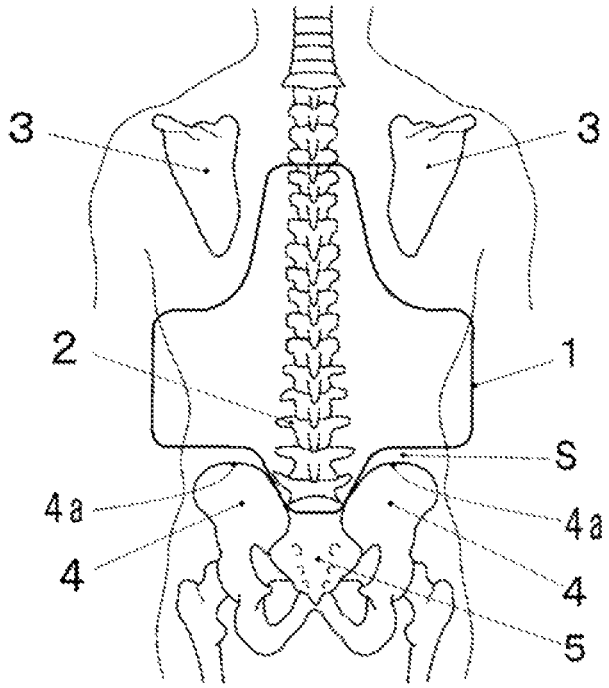
FIG. 3 is a drawing showing a positional dimension between the backrest of the present invention and a back of a person.
Figure 4:
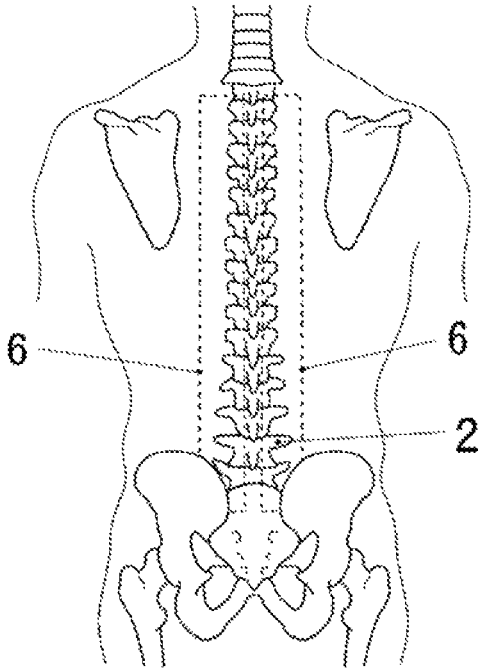
FIG. 4 is an explanatory drawing showing a position of erector spinae muscles.

FIG. 3 is a drawing showing the positional dimension between the backrest of the present invention and the back of a person. An upper portion of the backrest 1 supports the erector spinae muscles 6, 6 within the range of not being affected by projections of the both shoulder blades 3, 3. A lower portion of the backrest 1 supports the erector spinae muscles 6, 6 between the both iliac bones 4, 4 within the range of not being affected by the both iliac bones 4, 4. The width of the backrest 1 is broadened to right and left for increasing the supporting area within a range where the backrest 1 is not in contact with a lower part of ribs and the both iliac crests 4*a*, 4*a*. A space S is provided between the backrest 1 and the both iliac crests 4*a*, 4*a*.

Figure 5:
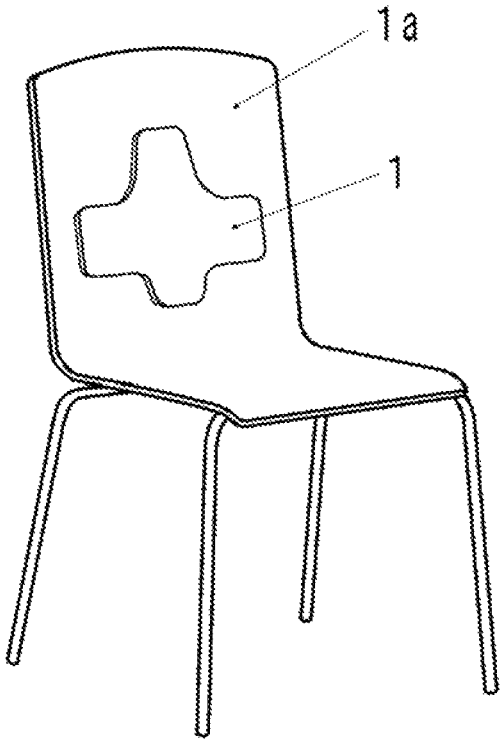
FIG. 5 is a perspective view where the backrest of the present invention is applied to the chair having a back plate covering an entire back of a person.

FIG. 5 is a perspective view where the backrest of the present invention is applied to the chair having a back plate covering an entire back of a person. A back plate 1*a* and a sitting portion (seat) are integrally formed by molded board (rigid body). The back plate 1*a* is formed in a planar shape and the backrest 1 made of a urethane foam is covered on the surface of the back plate 1*a*. The backrest 1 is formed to protrude approximately 20 mm for avoiding the influence of the back plate 1*a* to the shoulder blade 3. Although the urethane foam is deformed when a person leans on it, it is preferable that a protrusion remains approximately 15 mm even when the urethane foam is deformed.

Figure 6:
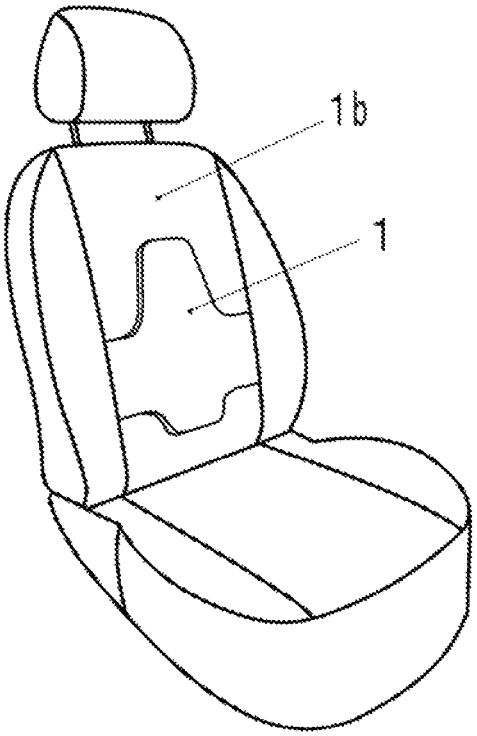
FIG. 6 is a perspective view where the backrest of the present invention is applied to a seat back of an automobile.

FIG. 6 is a perspective view where the backrest of the present invention is applied to a seat back of an automobile. The relation between a seat back 1*b* and the projection amount of the backrest 1 is same as that of the embodiment shown in FIG. 5. The urethane foam having a thickness of approximately 10 mm is arranged on the back of the coating material of the surface of the backrest 1. Furthermore, the back of the urethane foam is supported by the planar rigid body. Thus, the planar shape of the backrest 1 is maintained and the seat back 1*b* and the backrest 1 are supported by springs so that they are elastically moved back and forth while being synchronized with each other.

Figure 7:
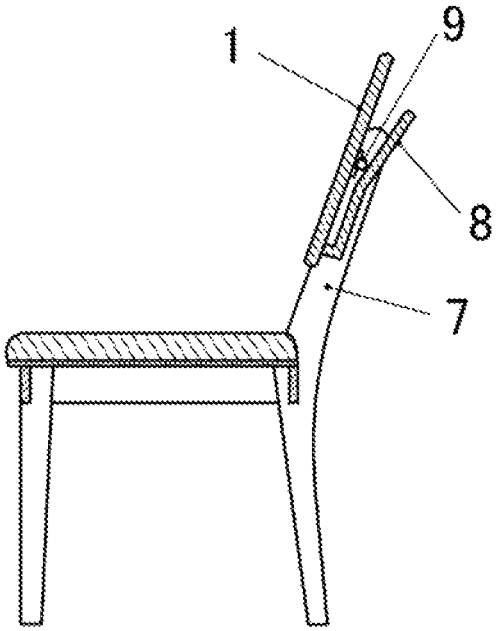
FIG. 7 is a vertical center cross-section of the chair showing another example.

FIG. 7 is a vertical center cross-section of the chair showing another example. The backrest 1 is joined with supports 7 of the chair by a joining member 9 having a rotation axis rotating in the horizontal direction so that the backrest 1 moves in a seesaw manner. The position of the rotation axis is made to consist with the action point of a leaning force applied to the backrest 1. In the backrest 1, the action point is located near the center in the vertical direction. Although the rotation axis is provided on the back surface of the backrest 1 in the present embodiment, it is also possible to provide the rotation axis on both side surfaces of the backrest 1. Because of this, the distance from the surface of the backrest 1 to the rotation axis can be shortened. Thus, the moving amount of the surface caused by the swing angle of the backrest 1 can be reduced. A regulating plate 8 regulates the swing angle of the backrest 1 and reinforces the connection strength between both supports 7. The swing angle of the backrest 1 from the seat surface seems to be appropriate when the swing angle is within the range of 112 degrees to 124 degrees (when the seat surface is horizontally placed).

DESCRIPTION OF THE REFERENCE NUMERALS

1: backrest, 1*a*: back plate, 1*b*: seat back, 2: spinal column, 3: shoulder blades, 4: iliac bones, 4*a*: iliac crests, 5: sacrum, S: space, 6: erector spinae muscles, 7: supports, 8: regulating plate, 9: joining member

The invention claimed is:

1. A backrest of a chair, wherein a width of the backrest is broadened to right and left at an intermediate portion in a vertical direction, the width of the intermediate portion is 30 cm, the width of a lower portion located below the intermediate portion is 8 cm at a bottom end of the lower portion and 10 cm at a top end of the lower portion, the width of an upper portion located above the intermediate portion is 13 cm at a bottom end of the upper portion and 8 cm at a top end of the upper portion, the height from the bottom end of the lower portion to the top end of the upper portion is 33 cm, the height of the lower portion is 6 cm, the height of the intermediate portion is 13 cm, and the backrest is formed by a planar rigid body.

2. A backrest of a chair, wherein a width of the backrest is broadened to right and left at an intermediate portion in a vertical direction, the width of the intermediate portion is 30 cm, the width of a lower portion located below the intermediate portion is 8 cm at a bottom end of the lower portion and 10 cm at a top end of the lower portion, the width of an upper portion located above the intermediate portion is 13 cm at a bottom end of the upper portion and 8 cm at a top end of the upper portion, the height from the bottom end of the lower portion to the top end of the upper portion is 33 cm, the height of the lower portion is 6 cm, the height of the intermediate portion is 13 cm, the backrest is formed by an elastic material having flexibility, and a rigid board is arranged behind the backrest to maintain a planar shape of the backrest.

* * * * *